US005361677A

United States Patent [19]

Warner et al.

[11] Patent Number: 5,361,677

[45] Date of Patent: Nov. 8, 1994

[54] FLASH SUPPRESSOR

[76] Inventors: Joseph G. Warner, 33828 Stonewood, Sterling Heights, Mich. 48077; Paul A. Petrovich, 11269 Judd Rd., Fowlerville, Mich. 48836

[21] Appl. No.: 179,086

[22] Filed: Jan. 10, 1994

Related U.S. Application Data

[62] Division of Ser. No. 48,594, Apr. 19, 1993, Pat. No. 5,303,634.

[51] Int. Cl.[5] ..... F41A 21/34

[52] U.S. Cl. ..... 89/14.2; 89/14.3

[58] Field of Search ..... 89/14.2, 14.3, 14.4

[56] References Cited

U.S. PATENT DOCUMENTS

| | | | |
|---|---|---|---|
| 1,111,202 | 9/1914 | Westfall | 89/14.4 |
| 1,127,250 | 2/1915 | Humm | 89/14.4 |
| 1,341,363 | 5/1920 | Fiala | 89/14.4 |
| 1,342,978 | 6/1920 | Young | 89/14.3 |
| 1,667,186 | 4/1928 | Bluehdorn | 89/14.3 |
| 2,792,760 | 5/1957 | Hammer | 89/14.2 |
| 3,500,955 | 3/1970 | Werbell | 89/14.2 |
| 3,677,132 | 7/1972 | Pleuge | 89/14.2 |
| 5,123,329 | 6/1992 | Irwin | 89/14.3 |

*Primary Examiner*—David Brown

*Attorney, Agent, or Firm*—Peter A. Taucher; David L. Kuhn

[57] ABSTRACT

Disclosed is a flash suppressor for guns which controlledly vents ignited high pressure gas exiting a gun muzzle. The gas is vented essentially radially outward through coils or rings of the suppressor in a 360 flow degree pattern away from a longitudinal axis of the suppressor.

4 Claims, 9 Drawing Sheets

FLASH SUPPRESSOR

GOVERNMENT USE

The invention described herein may be manufactured, used and licensed by or for the U.S. Government for governmental purposes without payment to us of any royalty thereon.

This application is a divisional of application Ser. No. 08/048,594 filed Apr. 19, 1993, now U.S. Pat. No. 5,303,634.

BACKGROUND AND SUMMARY

Present flash suppressors consist of a cylindrical element fit onto the muzzle of a gun barrel, the element having a set of apertures encircling a point along the longitudinal axis of the suppressor. When a soldier fires the gun, there occurs a set of elongate radial flashes and a reduced forward flash from the barrel. These flashes center on the muzzle of the gun and, especially at night, allow enemy personnel to use the flashes as directional indicators to accurately estimate the location of the soldier relative to the muzzle.

Our flash suppressor addresses the above problem by channelling the flash into a cloud-like or somewhat spherical space about the gun muzzle, whereby the flash gives less indication of the location of a soldier firing the gun. Our invention comprises a set of spring coils or rings disposed along the suppressor's longitudinal axis, which is in registry with the axis of the gun barrel. The flash vents through spaces between the coils or rings.

DETAILED DESCRIPTION

Figure 1:
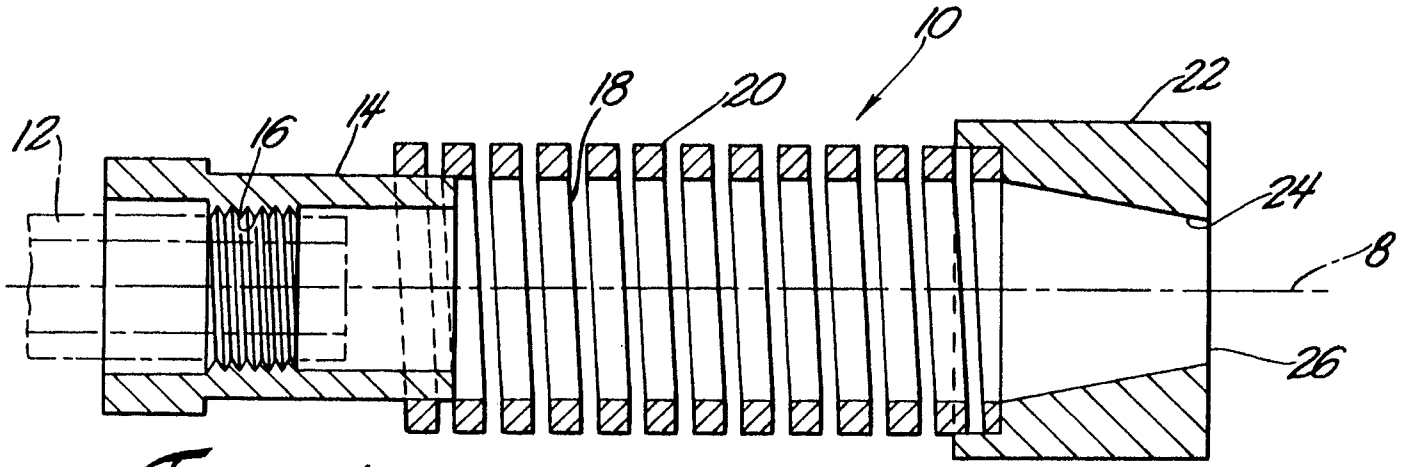
FIG. 1 is a longitudinal sectional view of our improved flash suppressor.

Shown in FIG. 1 is a sectional view of a flash suppressor 10 mounted at the end of gun barrel 12 concentric with axis 8. Means for detachably mounting the suppressor to barrel 12 can include a clip or bracket or other known mounting mechanisms, the mounting means typically being a tube 14 whose internal threads 16 engage complimentary threads on the exterior of the gun barrel. A generally cylindrically shaped coil spring element 18 is permanently affixed to tube 14, as by welding, but any conventional method of permanent attachment may be used. The individual coils of element 18 are spaced apart at equal intervals which preferably are axially narrower than the axial cross-sectional dimension of the coils. The coils' cross sections are shown as square at 20 in FIG. 1 but these cross sectional may be of almost any shape, and examples of other cross sectional shapes are shown in FIGS. 4A through 4F. Suppressor 10 has an exit end 22, which is a generally cylindrical element defining a frustoconically shaped bore 24 tapered in the forward direction to an opening 26.

When a projectile is fired from barrel 12, the projectile will pass through flash suppressor 10 and out opening 26. The projectile will be followed by a rapidly expanding body of burning gas, or flash. A portion of this gas will escape between the coils 18 so that the gas is spread about a spiralled pattern all along the suppressor 10, whereby the gas is disposed in a cloud about suppressor 10. The cloud's average radius is less than the length of flashes extending radially from the gun muzzle equipped with a conventional flash suppressor. Also, the cloud's average diameter is less than the length of a flash extending forward from gun barrel having no suppressor. The fact that the flash is in a cloud formation and not an elongate body obscures the direction of firing of the gun, so that the position of the person firing the gun is less easily determined.

Immediately after the projectile is fired from barrel 12, the gas from the barrel is at its highest blast pressure. As the gas then passes forward through end 22, it translates end 22 forward away from barrel 12 because of gas pressure on the surface of bore 24. Translation of end 22 stretches coil spring element 18 slightly forward, whereby openings between coils widen and enhance the escape of the gas. The mass of end 22 and the spring rate of element 18 can be selected so that there is a slight, controlled interval while the openings between the coils fully widen. The effect of the interval is to create a varied gas flow restriction, wherein the gas is more restricted initially, when its pressure is highest and is less restricted after a controlled delay time during which gas has begun dispersal and lost some of its pressure. It is believed that the overall volume in which burning gas disperses will be reduced, that the intensity of the flash will be reduced, and that the sound of the gun shot will be muffled somewhat, whereby the gun shot will be more difficult to trace by sight or sound. It is noted that some of the gas's energy that would add to the intensity of the sound of the gunshot is absorbed by expansion of element 18, whereby element 18 has an additional quieting effect.

It is contemplated that suppressor 10 will be used on a rapidly repeating weapon such as an automatic rifles or a machine gun. When such a weapon is fired, periodic pulses of high pressure gas will be generated and these pulses will exert periodic axial force components on end 22. For any given combination of rapidly repeating weapon and ammunition therefor, one can choose the strength and spring rate of coil spring element 18 and also control the mass of end 22 so that end 22 oscillates "in tune" with the periodic pulses. That is, a first pulse will translate end 22 forward away from barrel 12 against the bias of element 18 and subsequently, coil 18 will begin translating end 22 backward toward barrel 12, and during the backward translation, a second pulse strikes the end. End 22 again translates away from barrel 12 against the bias of element 18 and again begins to return toward barrel 12, whereupon a third pulse strikes end 22, and so forth.

Because end 22 is translating in the opposite direction of gas pulses striking it, the ability of end 22 to absorb kinetic energy from the pulses is maximized, whereby the ability of suppressor 10 to muffle gun shot sounds is enhanced. Further, the pulse's transfer of energy to end 22 tends to pull barrel 12 forward so as to counter the backward "kick" or reaction force of the gun (not shown) resulting from firing the gun. For rapidly firing weapons, the transfer of energy to end 22 counters the shaking of the gun as it fires and thus allows a tighter firing pattern on a target.

Figure 2:
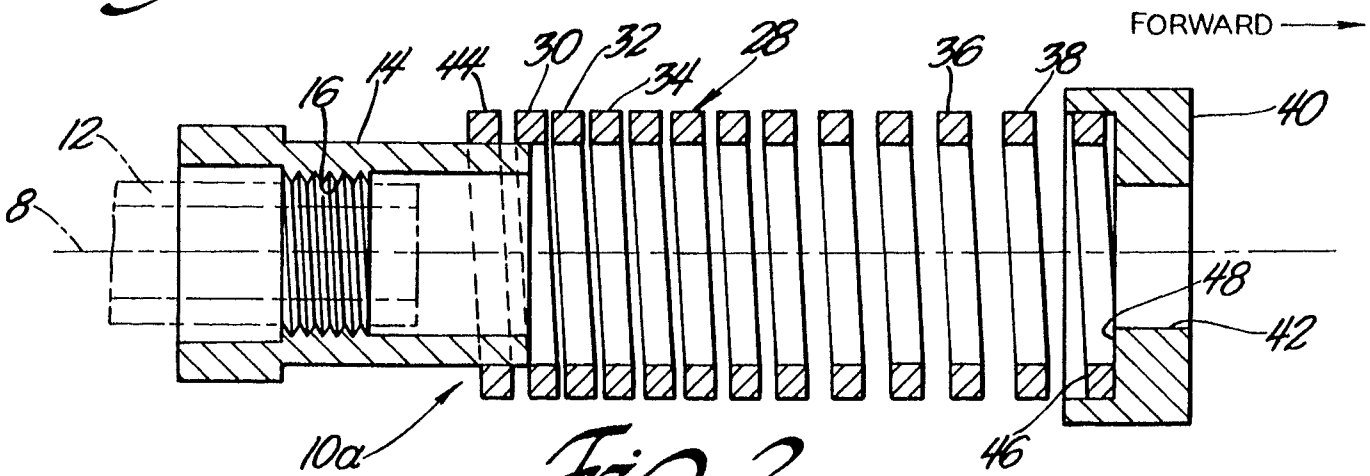
FIG. 2 is a longitudinal sectional view of a variation of the FIG. 1 suppressor.

FIG. 2 is a slightly modified version 10A of the FIG. 1 flash suppressor wherein nonlinear coil spring element 28 replaces coil spring element 18. First active coil 30 will have a typical axial distance from second active coil 32 of 0.1 to 0.4 millimeters, and the axial distance between coil 32 and third active coil 34 is greater. The axial distance between succeeding pairs of coils continues to increase until a maximum occurs, the maximum being the distance between penultimate active coil 36 and ultimate active coil 38. Exit end 40 defines a straight cylindrical through bore 42 centered on axis 8, the bore diameter being smaller than the inner diameter of coil spring element 28, thereby exposing a part of toroidal surface 48, which axially faces barrel 12. Spring element 28 is attached to tube 14 and end 40 at respective inactive coil segments 44 and 46 by welding or other suitable means. The cross sections of the coils in FIG. 2 need not be square and may optionally be, for example the shapes depicted in FIGS. 4A through 4F.

After a projectile is fired from barrel 12 in FIG. 2, the rapidly expanding body of gas that subsequently exits barrel 12 will vent first through the gap between coils 30 and 32, whereby the body of gas loses some of its pressure. As the body of gas continues to expand, it reaches successively wider gaps at successively lower pressures, whereby the inertia and mass of flow between all of the gaps tends to equalize. The equalization of mass flow and inertia reduces the maximum distance that any gas particles can travel from suppressor 10A while they are burning and emitting light, whereby the size of visible flash from barrel 12 is reduced, at least from points forward of end 42.

Figure 3:
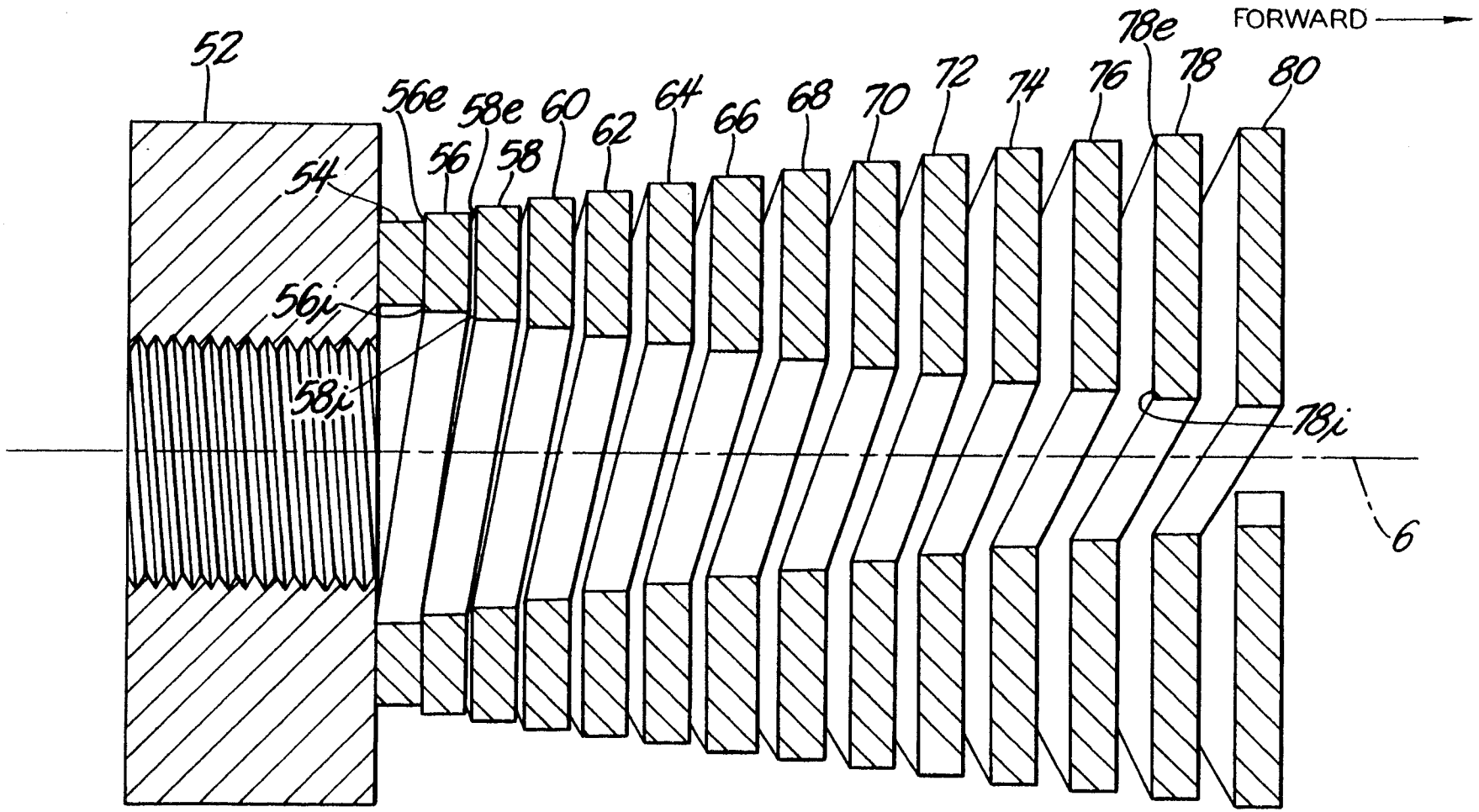
FIG. 3 is a longitudinal sectional view of a third embodiment of our flash suppressor.
Figure 4A:
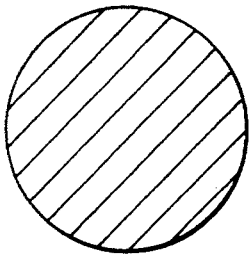
FIGS. 4A through 4F show representative cross sections of coils of springs that form a part of our flash suppressor.
Figure 4B:
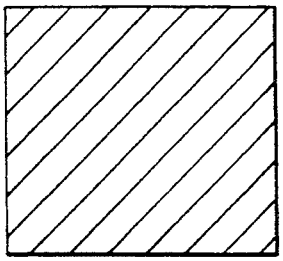
Figure 4C:
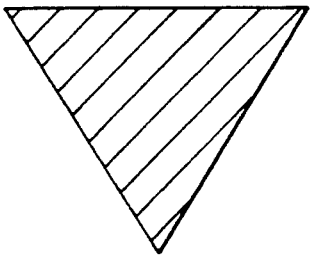
Figure 4D:
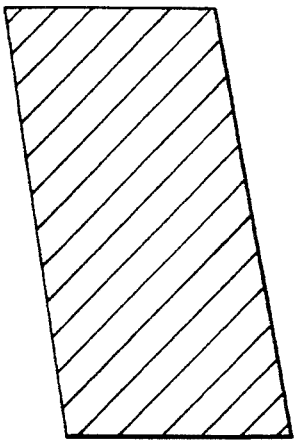
Figure 4E:
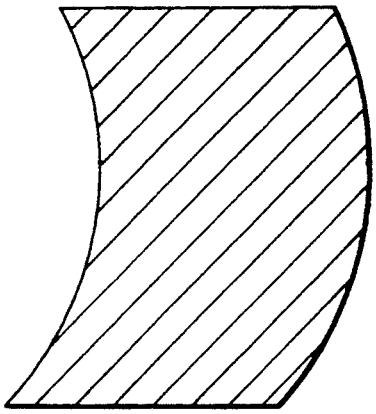
Figure 4F:
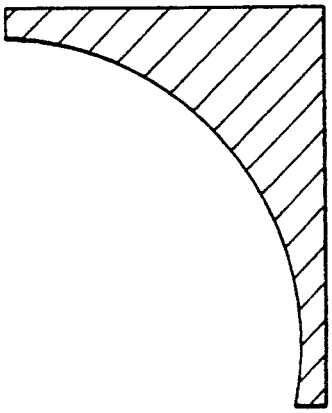

FIG. 3 shows an alternate flash suppressor 50 wherein internally threaded collar 52 is substituted for tube 14 and performs the function thereof, and the coils have a different configuration from coils in FIGS. 1 and 2. Coil segment 54 is fixed to collar 52 and either bears against coil 56 or forms an axial gap therewith smaller than the gap between coils 56 and 58. Coil 56 extends both radially more inward and radially more outward than coil segment 54 so that coil 56 has an axially rearward facing edge zone **56*i* inside suppressor 50 and another axially rearward facing zone 56*e* at the exterior of suppressor 50, edge zones 56*i* and 56*i* being partial spirals about axis 6. Likewise, coil 58 extends both radially more inward and radially more outward than coil segment 56 so that coil 58 has an axially rearward facing edge zone 58*i* inside suppressor 50 and another axially rearward facing zone 58*e* at the exterior of supressor 50, edge zones 58*i* and 58*e* being partial spirals about axis 6. In similar fashion coils 60 through 80 have axially rearward facing edge zones both inside suppressor 50 and on the exterior of the suppressor, as for example, at inner edge zone 78*i* and exterior edge zone 78*e*. The axial width of gaps between coils increases in the forward, direction, away from collar 52 until a maximum axial gap width occurs between coils 78 and 80. Typically, the coils increase in mass from coil 54 to coil 80. When a gun having suppressor 50 is fired, rapidly expanding gas will pass through collar 52 and some of the gas will strike the inner edge zones, such as 56*i*, 58*i* and 78*i*, and impart forward force on the suppressor, which force is transferred to the gun to partly counter the rearward recoil of the gun. The gas imparts another, smaller forward force on the outer edge zones, as at 56*e*, 58*e* and 78*e*** as the gas continues to expand upon exiting radially outwardly from between the coils, whereby gun recoil is further countered.

Figure 5:
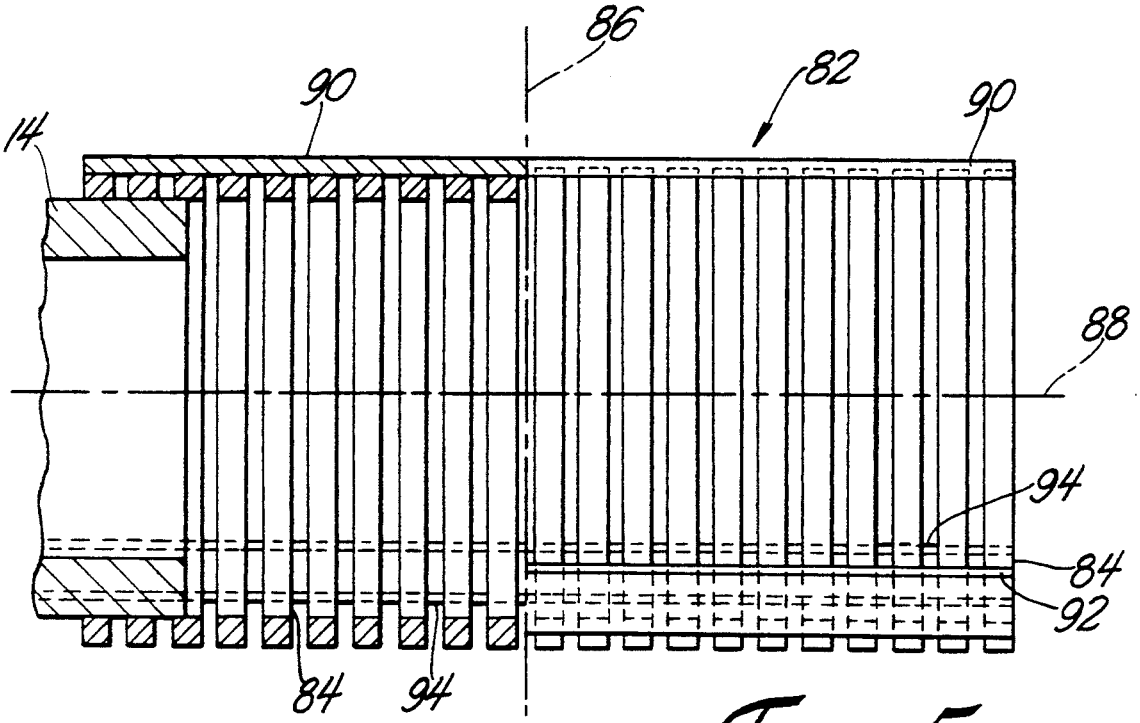
FIG. 5 is a partly sectioned side elevational view of a fourth embodiment of our flash suppressor.
Figure 6:
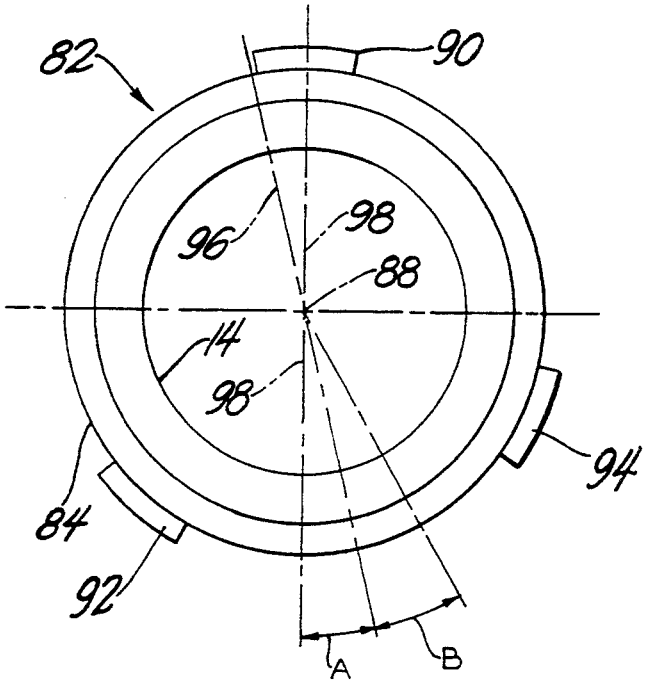
FIG. 6 is an end elevational view of the fourth embodiment of the flash suppressor.

FIGS. 5 and 6 show another variation 82 of our flash suppressor wherein tube 14 attaches to a gun barrel as previously described and suppressor 82 includes a series of rings 84 centered along axis 88. In FIG. 5, the rearward portion of suppressor 82 is shown in longitudinal section and the front portion of the suppressor is not sectioned. The rings need not be equally spaced but instead can have increasingly wider axial gaps therebetween in a progression from the ring nearest tube 14 to the ring most remote from tube 14, i.e., in the aft-to-fore direction. Also, the rings can be of any desired cross section, the cross sections in FIGS. 4A through 4F being examples of possible cross sections. As will be discussed later, the cross sectional shapes of the rings can also take the form of the configuration shown in FIG. 9.

Rings 84 are fixed to a set of three elongate members 90, 92, and 94 disposed parallel to axis 88, these members having a flat arcuate shape as best seen in FIG. 6. As can also be seen the front view of suppressor 82 in FIG. 6, the angular distance between members 92 and 90 is greater either than the angular distance between member 90 and member 94 or the angular distance between member 92 and member 94. Member 94 is typically angularly midway between members 90 and 92 and has the same angular with as these latter members or a greater angular width than these latter members. Typically, centerline 96 bisecting the angular distance between members 92 and 94 forms angle "A" of 15 degrees with center line 98, which bisects member 90, and angle "A" preferrably varies by no more than 30 degrees in either direction. The purpose of the particular juxtaposition of the elongate members is to compensate for force acting on a rifled gun barrel in a radial direction from axis 88 when the gun is fired. In FIG. 6, if the gun has right hand rifling, then the gun and suppressor 82 tend to move up and to the right when the gun recoils upon firing. However the high pressure, rapidly expanding gas exiting the gun barrel 14 will exert radial forces on the members 90, 92 and 94 and the resultant of these radial forces counteracts the aforementioned upward, rightward motion of the gun upon recoil. In other words, the net radial force of gas exiting suppressor 82 counteracts a radial force component on the gun barrel due to its rifling. To compensate for left hand rifling, member 90 will be moved from its FIG. 6 position, where its center is clockwise by angle "A" from centerline 96 to a position of rings 84 where member 90 is counterclockwise by angle "B" from centerline 96. Angle "B" is equal to angle "A".

Figure 7:
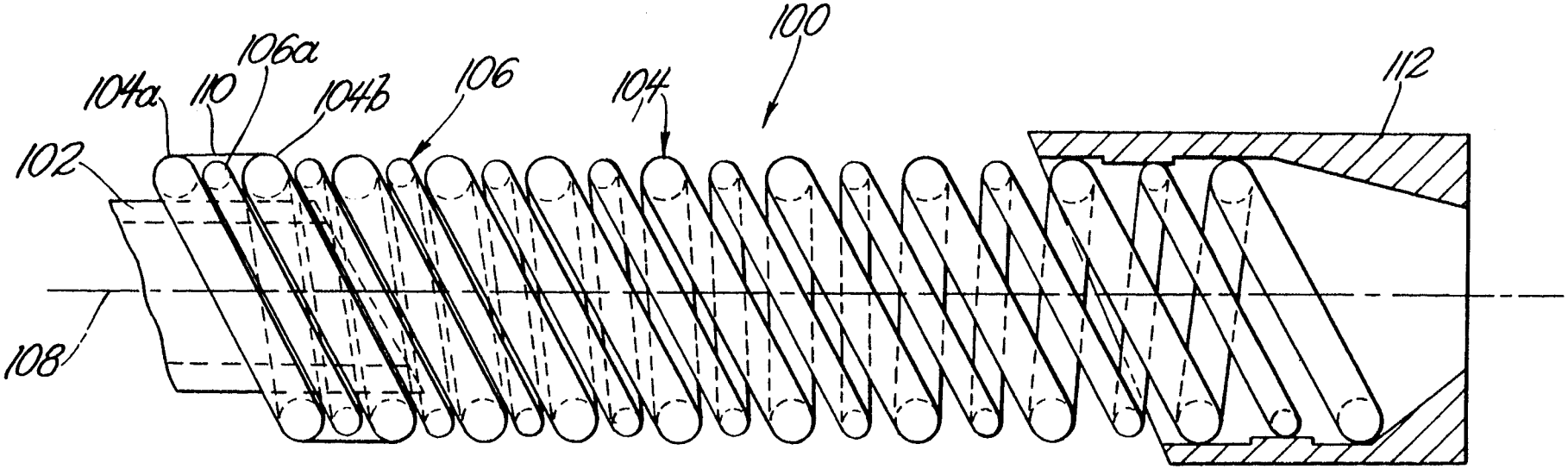
FIG. 7 is a side elevational view of a fifth embodiment of our flash suppressor.

FIG. 7 shows another embodiment 100 of our flash suppressor wherein tube 102 connects the suppressor to a gun barrel in much the same fashion as tube 14 in FIG. 1. Suppressor 100 has a first nonlinear coil spring 104, which winds about axis 108 and has two inactive coils 104*a* and 104*b* fixed to tube 102. A second nonlinear coil spring 106 is also wound about axis 108, the coils of spring 108 being disposed between the coils of spring 104. An inactive coil 106*a* is fixed to inactive coils 104*a* and 104*b* by a weld body 110, whereby inactive coil 106*a* is fixed relative to tube 102. It will be noted that the pitches of springs 104 and 106 increase equally to each other from tube 102 to end 112. The coils of these two springs have different cross sections in that the spring 104 coils have a larger circular cross section than the circular cross section of spring 106 coils, although the respective coils may have different cross-sectional shapes as well. As with previously described embodiments of our suppressor, the cross sections of the coils in suppressor 100 can be of any desired shape and FIGS. 4A through 4F illustrate examples of cross sectional configurations.

Figure 9:
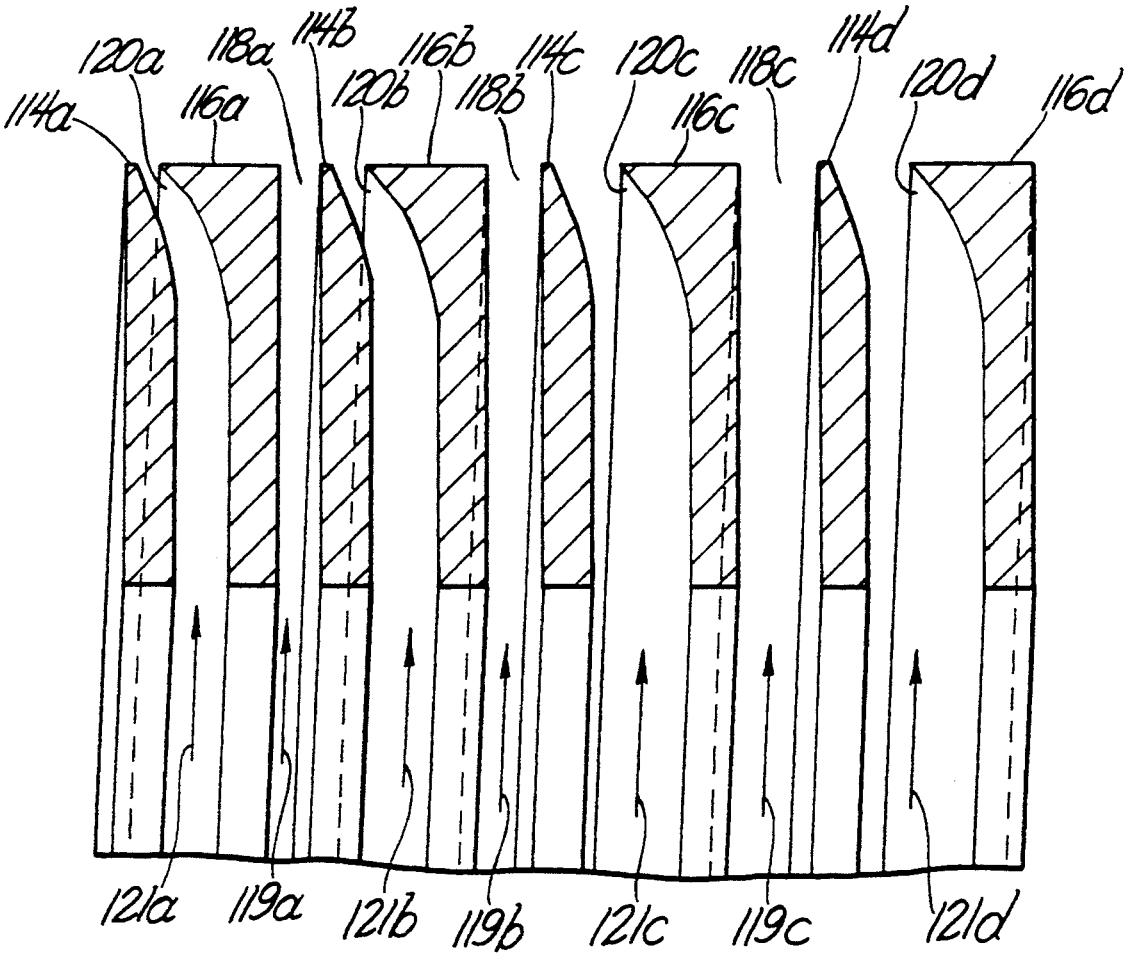
FIG. 9 is a detail view of an alternate cross sectional shape for the coils shown in the previous embodiments.

FIG. 9 is a partly sectioned detail view showing two particularized coil cross sections in interleaved or alternating relation. The coils in FIG. 9 may be regarded as being paired so that radially outwardly tapering coil 114*a* is paired with radially outwardly diverging coil 116*a*, coil 114*b* is paired with coil 116*b*, coil 114*c* is paired with coil 116*c* and coil 114*d* is pair with coil 116*d*. The pairs of coils are in a nonlinear progression whereby the distance between pairs increases in the forward direction away from a gun barrel, which is from the left to the right in FIG. 9. Thus, cross-sectionally straight interpair gap 118*a* is axially narrower than cross-sectionally straight intra pair gap 118*b*, which in turn is axially narrower than cross-sectionally straight inter pair gap 118*c*. The distance between the coils in each pair also increases in the forward direction such that curved intra pair gaps 120*a*, 120*b*, 120*c* and 120*d* are increasingly axially wider in the forward direction. It is contemplated that the FIG. 9 coil configuration will be formed by two different springs interleaved with on another in a fashion to springs 104 and 106 in FIG. 7, but the FIG. 9 configuration cam be formed from a single spring. The FIG. 9 configuration of cross sectional shapes may also be incorporated on a series of rings spaced at selected intervals along an axis in much the same fashion as rings 84 in FIG. 5.

When an expanding body of gas is generated upon firing a gun, some of the gas will travel radially outward through the gaps in FIG. 9 as shown by directional arrows 119*a* through 119*c* and directional arrows 121*a* through 121*d*. The turbulence of gas in curved gaps 120*a* through 120*d* will be increased by the curve at the radially outer end of the gap and by the narrowing of these curved gaps at their radially outer ends. Gas streams exiting the curved gaps will collide with gas streams exiting straight gaps 118*a* through 118*c*, whereby further turbulence is created. The turbulence will disguise and partly muffle the gun shot sound made by the rapidly expanding gas body when the gun is fired. It is believed that the distance that gas travels from suppressor 120 while still emitting light will also be reduced, thereby lowering the visibility of the gun flash.

Figure 8:
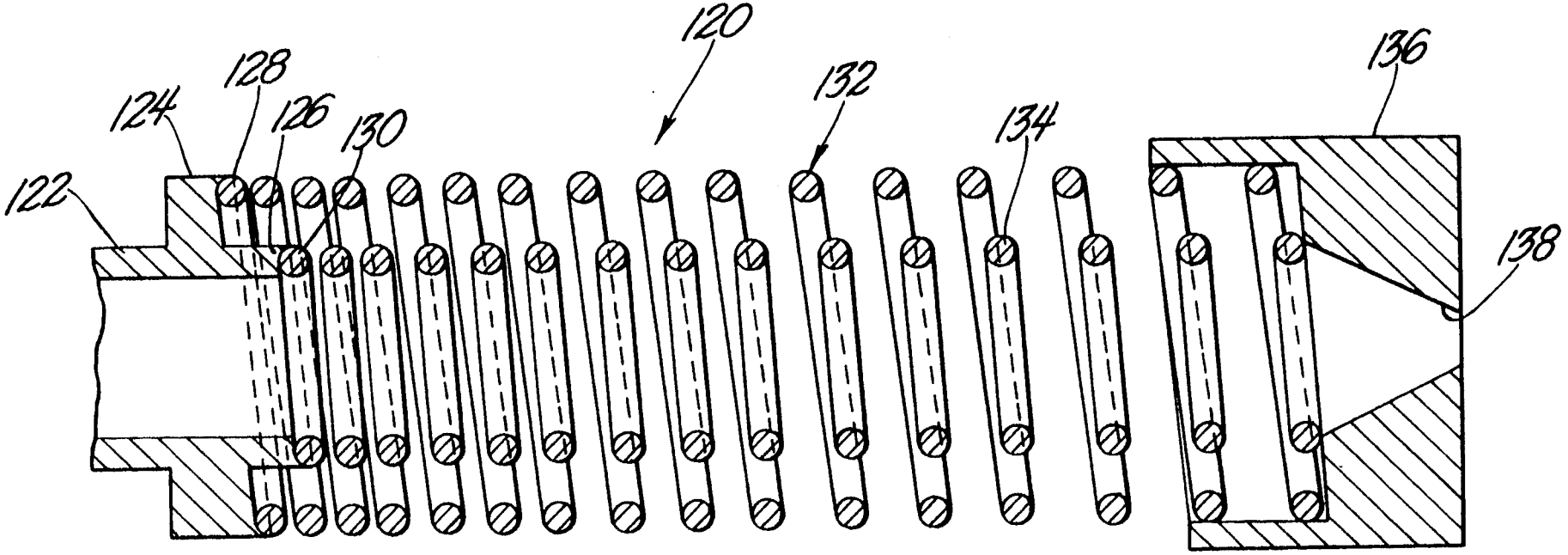
FIG. 8 is a longitudinal section of a sixth embodiment of our flash suppressor.

Another embodiment 120 of our flash suppressor is shown in FIG. 8, wherein tube 122 affixes to a gun barrel (not shown in FIG. 8) in the same fashion as tube 14 of FIG. 1. Tube 122 has an external annular boss 124 to which inactive coil 128 of outer coil spring 132 is fixed. Tube 122 also has an annular cupped lip zone 126 fixedly seating inactive coil 130 of inner coil spring 134. At the opposite end of the coil springs from tube 122 is fixed end 136 which defines a forwardly tapered aperture 138. Both coil spring 132 and coil spring 134 are shown as being nonlinear, the spaces between coils increasing in a progression from tube 122 to end 136, but the inter-coil spaces of either or both of these springs can be equal. Also, the cross sectional shape of the coils in FIG. 8 need not be round, but may be of any cross sectional shape previously described. The FIG. 8 coil springs have equally varied pitches but the coils of inner spring 134 are axially offset from the coils of outer spring 132. Optionally, the pitch of inner coil spring 134 may vary differently than the pitch of outer coil spring 132. The effect of the dual coil spring configuration of FIG. 8 is to induce turbulence in gas expanding outward through the springs so as to partly muffle the gun shot sound made by this gas.

Figure 10:
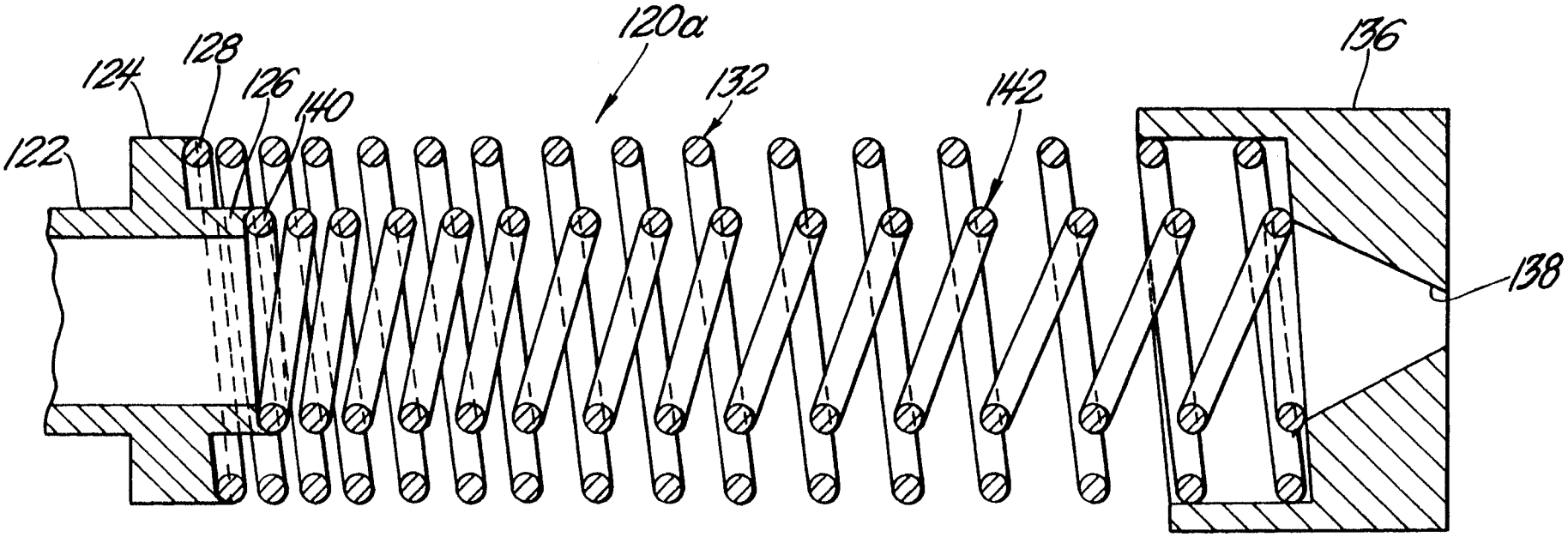
FIG. 10 is a variation of the embodiment of the flash suppressor shown in FIG. 8.

FIG. 10 is a variation 120*a* of the FIG. 8 embodiment wherein inner coil 142 replaces inner coil 134 and inactive coil 140 replaces inactive coil 130. In FIG. 10, inner coil spring 142 spirals in the opposite angular direction as outer coil spring 132.

Figure 11:
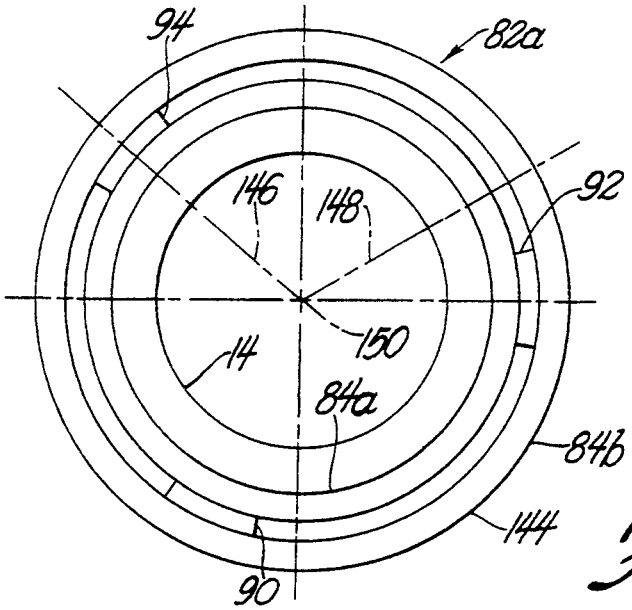
FIG. 11 is an end elevational view showing a modification of the fourth embodiment of our invention shown in FIGS. 5 and 6.
Figure 12:
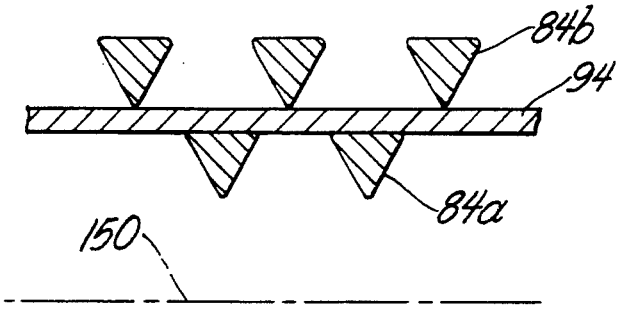
FIGS. 12 and 13 show the cross sectional shape and radial juxtaposition of rings of and members attaching the rings together in FIG. 11.
Figure 13:
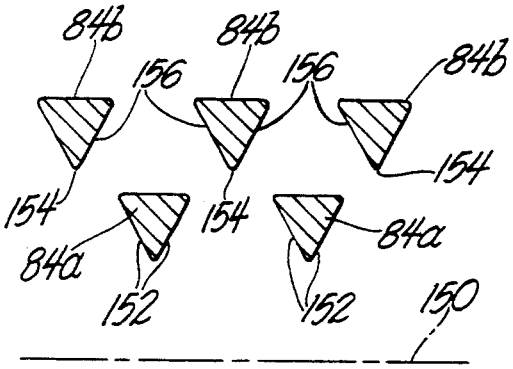

FIG. 11 is a variation of suppressor 82 of FIG. 6. In suppressor 82*a* of FIG. 11, rings men, hers 90, 92 and 94 are in the same positions relative to each other as in FIG. 6 but are disposed between inner rings 84*a* and outer rings 84*b*. Rings 84*a* and 84*b* are triangular in cross section as can be seen in FIGS. 12 and 13 and are concentric with longitudinal axis 150 of suppressor 82*a*. FIG. 12 is a section associated with radius 146 in FIG. 11 and FIG. 13 is a section associated with radius 148 in that figure. As best explained in conjunction with FIG. 13, high pressure gas in suppressor 82*a* will expand outward relative to axis 150 toward rings 84*a* and some of the gas will deflect off sides 152 of these rings. The gas will be concentrated toward points 154 on rings 84*b* and the outward flow of gas will diverged as this flow is directed along sides 156 of these rings. The flow will be reconcentrated by rings 84*b* as it leaves the suppressor. The overall effect of rings 84*a* and 84*b* on gas flow is to maximize turbulence so as to maximize flash suppression and partly muffle gun shot sounds.

Figure 14:
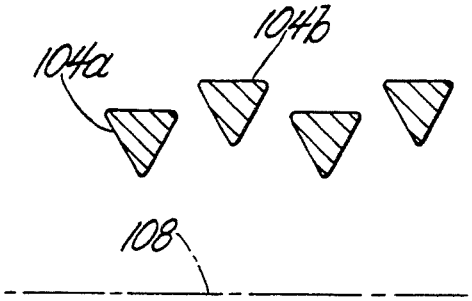
FIG. 14 shows a modification to the cross-sectional shapes of coils of springs shown in FIG. 7.

FIG. 14 shows cross sections of modified coils 104*a* and 106*a* that replace respective coils 104 and 106 in FIG. 7. Modified coils 104*a* and 106*a* will have a similar effect on gas flow to the effect of rings 84*a* and 84*b* just described.

We wish it to be understood that we do not desire to be limited to the exact details of construction shown herein since obvious modifications will occur to those skilled in the relevant arts without departing from the spirit and scope of the following claims.

We claim:

1. A flash suppressor for a gun, the suppressor acting to partly muffle gun shot sounds, comprising:

mount means for removably attaching the suppressor to the gun at a muzzle of a gun barrel;

an exit end of the suppressor;

two coil springs connected between the mount means and the exit end, a first coil spring disposed inside a second coil spring.

2. The flash suppressor of claim 1 wherein the second spring has a different pitch from the first spring.

3. The flash suppressor of claim 1 wherein the second spring spirals in an opposite direction than the first spring.

4. The flash suppressor of claim 1 wherein the exit end comprises a body having a bore therethrough, the body attached to at least one of the springs.

* * * * *